US008789246B2

(12) United States Patent
Yliluoma et al.

(10) Patent No.: US 8,789,246 B2
(45) Date of Patent: Jul. 29, 2014

(54) ASYMMETRIC BUTTERFLY CLASP

(75) Inventors: Timo Yliluoma, Helsinki (FI); Jukka Manni, Helsinki (FI); Mikko Sepänniitty, Helsinki (FI)

(73) Assignee: Suunto Oy, Vantaa (FI)

( * ) Notice: Subject to any disclaimer, the term of this patent is extended or adjusted under 35 U.S.C. 154(b) by 37 days.

(21) Appl. No.: 13/157,349

(22) Filed: Jun. 10, 2011

(65) Prior Publication Data

US 2012/0312052 A1 Dec. 13, 2012

(51) Int. Cl.
*A44C 5/02* (2006.01)
*A44C 5/24* (2006.01)

(52) U.S. Cl.
CPC ..... *A44C 5/246* (2013.01)
USPC ..... 24/265 EC; 24/68 J; 24/71 J; 24/265 WS

(58) Field of Classification Search
USPC ..... 24/68 J, 71 J, 265 EC, 265 WS, 265 R, 24/265 B, 483, 484
See application file for complete search history.

(56) References Cited

U.S. PATENT DOCUMENTS

| | | | | | |
|---|---|---|---|---|---|
| 1,741,421 | A | * | 12/1929 | Kraemer | 24/71 J |
| 1,809,278 | A | * | 6/1931 | Kestenman | 24/71 J |
| 2,532,840 | A | * | 12/1950 | Gaun | 24/71 R |
| 3,863,299 | A | * | 2/1975 | Hocq | 24/71 J |
| 4,382,318 | A | * | 5/1983 | Takimoto | 24/188 |
| 4,928,359 | A | * | 5/1990 | Gagnebin | 24/71 J |
| 5,689,859 | A | * | 11/1997 | Cuche | 24/71 J |
| 5,781,968 | A | * | 7/1998 | Widmer | 24/71 J |
| 5,857,243 | A | * | 1/1999 | Champion | 24/71 J |
| 5,870,803 | A | * | 2/1999 | Jorst | 24/265 WS |
| 6,073,316 | A | * | 6/2000 | Ferrario et al. | 24/71 J |
| 6,094,782 | A | * | 8/2000 | Gay et al. | 24/71 J |
| 6,308,382 | B1 | * | 10/2001 | Takahashi et al. | 24/265 WS |
| 6,401,307 | B1 | * | 6/2002 | Wild | 24/71 J |
| 6,434,798 | B1 | * | 8/2002 | Yamakawa et al. | 24/71 J |
| 6,493,908 | B2 | * | 12/2002 | Thalheim | 24/265 WS |
| 6,792,652 | B2 | * | 9/2004 | Ferrario | 24/71 J |
| 6,961,916 | B2 | * | 11/2005 | Sarrafzadeh et al. | 716/123 |
| 7,337,541 | B2 | * | 3/2008 | Grossiord et al. | 29/896.3 |
| 7,748,087 | B2 | * | 7/2010 | Dubois et al. | 24/71 J |
| D651,501 | S | * | 1/2012 | Maramotti | D8/343 |
| 2004/0163217 | A1 | * | 8/2004 | Ferrario | 24/71 J |
| 2007/0271747 | A1 | * | 11/2007 | Yamamoto | 24/71 J |

FOREIGN PATENT DOCUMENTS

| | | | |
|---|---|---|---|
| CH | 701806 | A2 | 3/2011 |
| EP | 0913106 | A1 | 5/1999 |
| EP | 0914781 | A1 | 5/1999 |
| EP | 1925227 | A1 | 5/2008 |
| JP | H0956422 | A | 3/1997 |
| WO | WO 2007072108 | A1 | 6/2007 |
| WO | WO 2008084881 | A1 | 7/2008 |

* cited by examiner

*Primary Examiner* — Robert J Sandy
*Assistant Examiner* — David Upchurch
(74) *Attorney, Agent, or Firm* — Seppo Laine Oy; Joshua P. Wert

(57) ABSTRACT

A clasp according to embodiments of the present invention is particularly well suited to wrist bands of diving watches, specifically metallic link type wrist bands. Such a clasp can be worn in a first closed position during normal usage against a user's bare wrist. The same clasp can then extend so that the same watch and wrist band can be worn by a user over some additional material, such as a dive suit. The extension of the clasp is beneficial as it requires no tools, is simple and reliable.

23 Claims, 7 Drawing Sheets

ASYMMETRIC BUTTERFLY CLASP

FIELD OF THE INVENTION

The present invention relates to a clasp, such as for a watch band. More specifically, the present clasp has multiple positions which allow the watch band to be easily configured in different sizes. Embodiments of the present clasp are particularly well suited for metal watch bands for dive watches.

BACKGROUND OF THE INVENTION

Watch clasps and clasps for wrist bands and bracelets are well known. Generally, watch bands and bracelets can be broken in to two groups: metallic and non-metallic. For individuals that desire daily adjustability of the size of their wrist band they are almost always limited to non-metallic wrist bands.

Most metallic wrist bands and the like are adjusted initially when purchased to properly fit a user's wrist. This adjustment often entails removing links from the wrist band in the case of large adjustments and/or re-positioning arms of a clasp amongst various fixed positions via spring loaded rods in the case of small adjustments. In either case, some type of tool is generally required. Since the size of a users wrist does not change rapidly, there is rarely a need to make adjustments to the size of the wrist band.

One notable exception is for divers. Divers often wear diving suits which extend all the way to their wrist and/or hand. Divers, and possibly others who wear, for example, long gloves, would like to wear metallic watches but require an adjustability to account for the difference in size between their bare wrist and their covered wrist. Since adjusting the links in a metallic wrist band is not practical, there exists a need for a clasp which is capable of being worn in at least a first closed position on a bare wrist and in an extended position, for example on a covered wrist. Furthermore, there exists a need for the transformation between the two positions to be easy and reliable.

SUMMARY OF THE INVENTION

The object of the present invention is to provide a clasp for a wrist band which can be worn in multiple positions.

According to aspects of embodiments of the present invention, the clasp can be used with a wrist band having a plurality of links, wherein the links are preferably metallic. Furthermore, the wrist band can be that of a bracelet or of a watch.

A clasp according to embodiments of the present invention is particularly well suited to wrist bands of diving watches. Such a clasp can be worn in a first closed position during normal usage against a user's bare wrist. The same clasp can then extend so that the same watch and wrist band can be worn by a user over some additional material, such as a dive suit. The extension of the clasp requires no tools, is simple and reliable.

DETAILED DESCRIPTION OF EXEMPLARY EMBODIMENTS

Figure 1:
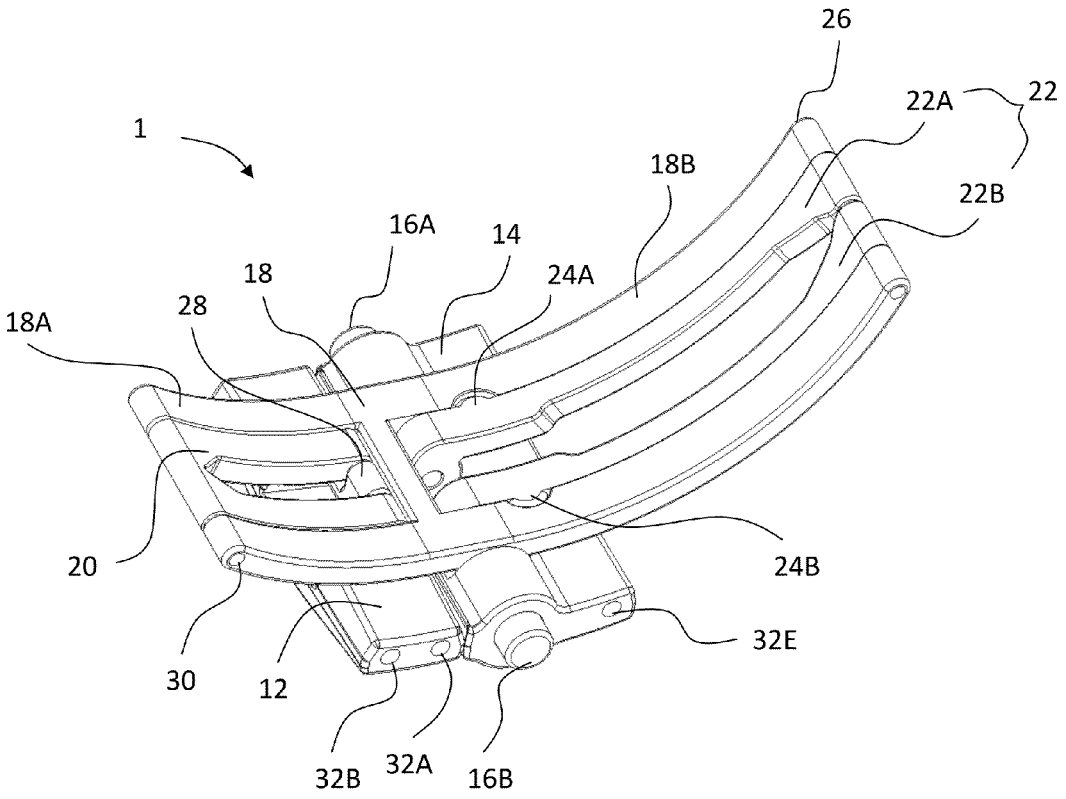
FIG. 1 shows a clasp for a watch band in a closed position.

FIG. 1 shows an asymmetric clasp according to an embodiment of the present invention in a closed position 1. The clasp joins a first link 12 to a second link 14. Links 12 and 14, as shown in the figures, are clasp links of a metallic wrist band such as those commonly used with watches and bracelets. As will be described below, while the present invention is particularly useful with regards to these types of wrist bands, the present invention can be realized with other forms of wristbands, links and clasps and is not limited to the links shown in the figures. For example, portions of the wristband links and/or clasp can be wholly, substantially or partially made of soft, non-metallic materials such as elastomers, rubber, silicone or plastic. Additionally, hard portions of the wristband links and/or clasp can be wholly, substantially or partially made of ceramics.

Figure 2:
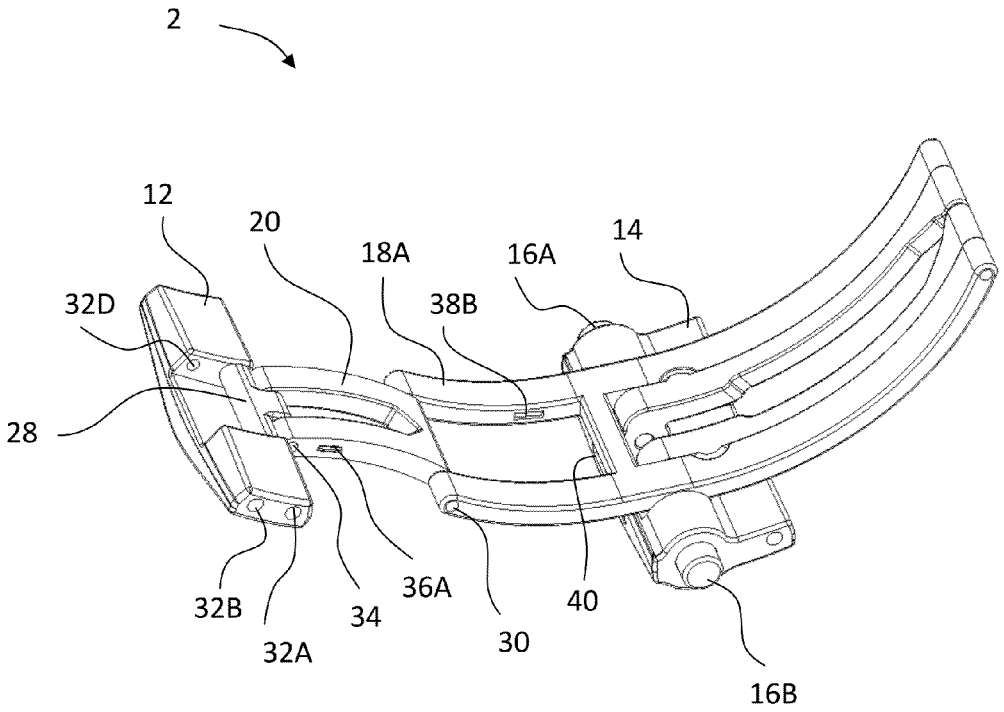
FIG. 2 shows a clasp for a watch band in an extended closed position.
Figure 4:
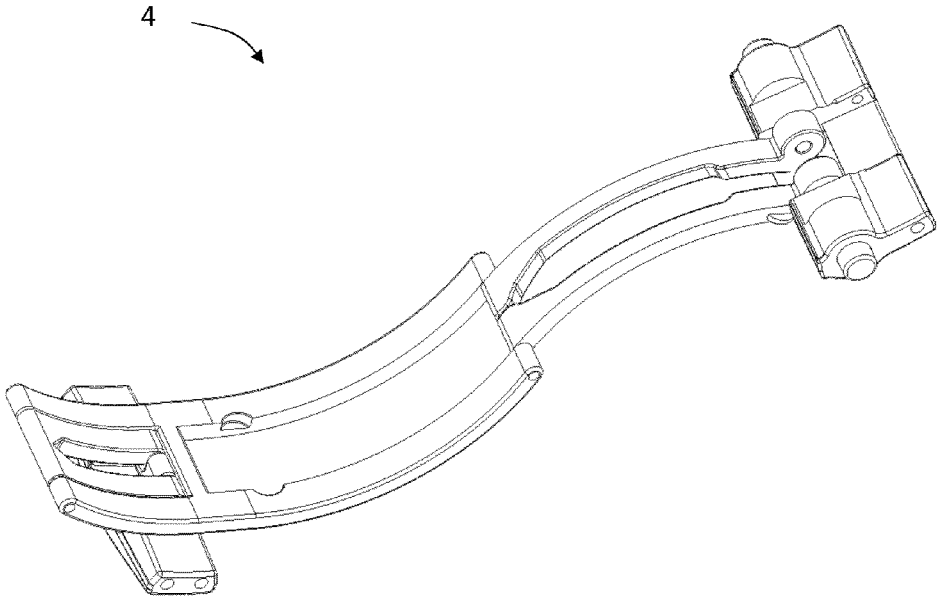
FIG. 4 shows a clasp for a watch in a optional extended position.

Links 12 and 14 are indirectly fixedly attached to each other via an asymmetric butterfly member 18, a first arm 20 and a second arm 22. From this fixed arrangement, links 12 and 14 can be releasably affixed directly to each other as shown in FIG. 1. Additionally, links 12 and 14 can be arranged in at least one releasably affixed separated position, as shown in FIGS. 2 and 4.

To reduce the likelihood that the clasp is inadvertently released, and thereby risking the loss of the watch or bracelet, it is important for the two links 12 and 14 to be fixedly attached to one another. When links 12 and 14 are fixedly attached then in the case that the clasp is inadvertently released the wrist band itself stays intact and should remain on a user's wrist. Therefore, link 12 is fixedly attached to a first arm 20 which in turn is fixedly attached to the asymmetric butterfly member 18, which is in turn fixedly attached to a second arm 22 which is finally fixedly attached to link 14.

In order to allow for the user to operate the clasp and for the clasp to assume its intended arrangements, the arms should be rotationally affixed to the links 12 and 14 and the asymmetric butterfly member 18. This can be accomplished in several ways. Furthermore, the way in which each connection is created can be the same for some or all of the connections or can differ for one or more of the connections.

As shown in FIG. 1, the asymmetric butterfly member 18 has a first end 18A, which comprises two extensions of equal length, and a second end 18B, which comprises two extensions of equal length, wherein the extensions of the first end 18A are shorter than those of the second end 18B. The first arm 20 is arranged to fit between the extensions of the first end 18A of the asymmetric butterfly member 18. Similarly, the second arm 22 is arranged to fit between the extensions of the second end 18B of the asymmetric butterfly member 18.

As shown, the first arm 20 is substantially the same length as the extensions of the first end 18A as well as substantially the same width as the gap between the extensions of the first end 18A. Thereby, when the first arm 20 is rotationally affixed at, or near to, the first terminal end of the asymmetric butterfly member 18 and the clasp is in a closed position the first arm 20 is substantially conformed to the asymmetric butterfly member 18. The first arm 20 is shown as being rotationally connected to the asymmetric butterfly member 18 via a pin-and-hole arrangement. First arm 20 has a rod 30 which extends from each side and fits in to a hole at the end of each extension of the first end 18A. This allows the arm to pivot rotationally up to 360 degrees. One of ordinary skill in the art will recognize other types of connections which can be used to connect the first arm 20 and the first end 18A which would not depart from the scope of the invention, such as a single rod which passes through holes in both the extensions and the arm, etc.

First arm 20 is shown as a single piece which has a solid first end connecting the arm 20 to the asymmetric butterfly member 18 and a forked second end connecting the arm 20 to link 12. Similarly to the connection between the first arm 20 and the asymmetric butterfly member 18, the connection between the first arm 20 and the link 12 is rotational. As can be seen in FIG. 2, first arm 20 is rotationally connected to connection piece 28, e.g. swivel link, via a pin-and-hole arrangement with rod 34. As with the connection between the first arm 20 and the asymmetric butterfly member 18, the other rotational connections can be different than the shown arrangement without departing from the scope of the invention.

FIG. 2 shows that the first arm 20 is rotationally connected to a swivel piece 28 which in turn is rotationally connected to the link 12. A function of the swivel piece 28 is to allow arm 20 and the asymmetric butterfly member 18 to stack conveniently on to link 12 when in the closed position. In part, this allows for a compact clasp in the closed position. Additionally, the shape and rotational connectivity of swivel piece 28 allows a smooth, substantially continuous connection between link 12 and arm 20 when in an open position as shown in FIG. 2. A Further benefit of such an arrangement is that it allows the clasp to be easily used in conjunction with existing link pieces and/or varieties of links. By changing the connection piece 28 to fit specific links, a single type/size clasp assembly can be used with a variety of different wrist bands. Alternatively, the first arm 20 can be directly rotationally connected to the first link by a variety of means, both permanently or removably.

A benefit to the present embodiment is that a watch band can be easily and reliably be extended without having to adjust the connection between the clasp and the links or the links themselves. For example, a diver can have the wrist band of their watch set to a desired length corresponding to their wrist size for everyday use. Then, via the present clasp, the diver can wear the same watch over their diving suit, e.g. wet suit or dry suit, without modifying the wrist band but by closing the clasp with the first arm 20 extended.

FIG. 2 shows the clasp in such an extended closed position 2. Link 14 is releasably affixed to the asymmetric butterfly member 18 as in closed position 1. However, link 12 is no longer affixed directly to either link 14 or the asymmetric butterfly member 18 allowing for several additional centimeters, or more, of length in the watch band, depending on the length of arm 20. This additional length can, for example, allow a user to comfortably user their watch over a diving suit. In part, due to the arrangement of link 12, swivel link 28, arm 20 and the asymmetric butterfly member 18, when in an extended closed position the inner portions of the clasp act in a manner similar to an additional link having a degree of flexibility as well as being generally in the same level against the wrist and/or diving suit as the rest of the band. This adds a degree of comfort which is sought after by many watch wearers, particularly divers and those needing a degree of flexibility in the length of their wrist bands.

The first arm 20 is releasably affixable to the asymmetric butterfly member 18 by a first means. The first means can be a single means or a combination of means which act together to releasably affix the first arm 20 to the asymmetric butterfly member 18. Said means can be, for example, frictional, mechanical, magnetic or a combination thereof.

In FIG. 2 there is shown a rectangular knob 36A on one side of the first arm 20 which also has a similar knob 36B (not shown) on the opposite side. These knobs are preferably shallow and capable of being pushed in to the recesses 38A (not shown) and 38B on the asymmetric butterfly member 18 respectively in order to hold the first arm when releasably affixed. While the knobs and recesses are shown as rectangles they may have any acceptable shape, such as quarter or half spherical, square, oblong, irregular, etc. The knobs and recesses should be sufficient to frictionally hold the first arm in place while being worn in a closed position yet being able to be release with an acceptable force of a user. In place of, or in combination with, the knobs and recesses as shown in FIG. 2 there may be one or more magnates or other means for holding the arm in place.

Figure 3:
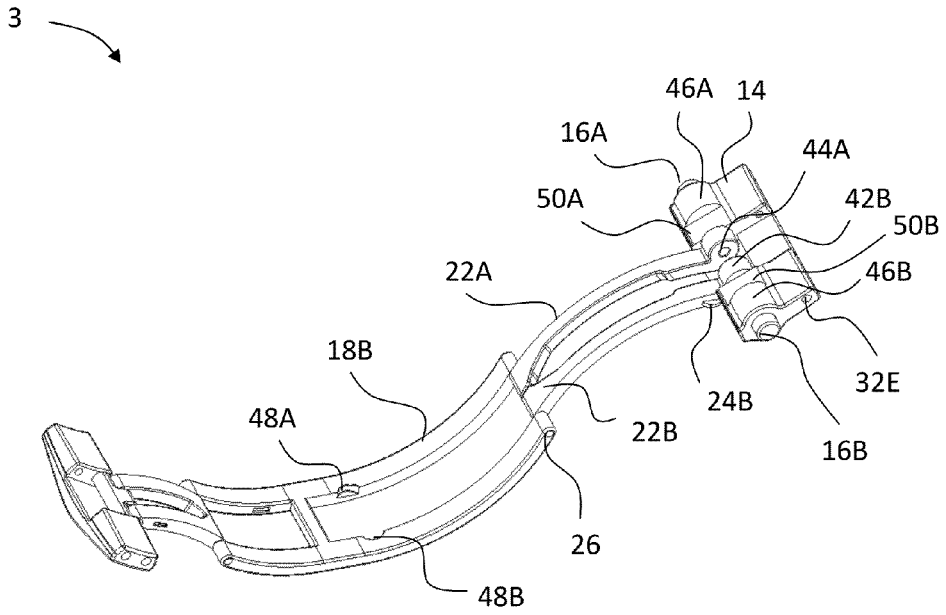
FIG. 3 shows a clasp for a watch band in an open position.

FIG. 3 shows the clasp in a fully open position 3 which is suitable for placing a wrist band on or off of a user. The second arm 22 is shown as two separate arms 22A and 22B. While the second arm 22 is shown as separate arms in the figures it can be a piece, e.g. similar to the first arm 20. Second arms 22A and 22B are rotationally connected to the asymmetric butterfly member 18 at one end and rotationally connected to the link 14 at the other end. Second arms 22A and 22B are rotationally connected at, or near to, the end of the second end of the asymmetric butterfly member 18B in a similar manner as discussed with regards to the first arm 20. One example, as shown, is a rod 26 which spans the entire width of the asymmetric butterfly member 18 which fits through holes in both extensions of the second end of the asymmetric butterfly member 18B and holes in the first end of each of the second arms 22A and 22B. The rod is preferably held in place by friction but may be held in place by any other known acceptable means.

Link 14 is shown with a button 16A on one side and a similar button 16B on the other side. Buttons 16A and 16B are either directly or indirectly connected to second arms 22A and 22B respectively. In the present example, button 16A is directly connected to second arm 22A by pin 44A. Similarly, button 16B is connected to second arm 22B by a pin 44B (not shown). The material chosen for the second arms 22A and 22B and/or their configuration may provide a sufficient spring coefficient so that when buttons 16A and 16B are pushed towards each other and released that the second arms 22A and 22B will move towards each other by an equal amount and then return to their resting position respectively. However, it may be necessary, or desirable, to add a spring to the housings 46A and 46B which cause the buttons 16A and 16B respectively to be pushed out when released, thereby causing the second arms 22A and 22B respectively to resume their resting position.

FIG. 3 also shows contoured areas 50A and 50B which receive the asymmetric butterfly member 18 when in the closed position 1. From FIG. 1, and closed position 1, it can be seen that the asymmetric butterfly member 18 is held in the closed position between the housings 46A and 46B and the second arms 22A and 22B respectively. The force of the second arms pressing against the asymmetric butterfly member 18 and in turn pressing against the housings can be a sufficient means for releasably affixing the second link 14 to the asymmetric butterfly member 18. In place of, or in addition to, said pressure force there can be one or more means for releasably affixing the second link 14 to the asymmetric butterfly member 18.

An example of said means are the wings 24A and 24B of second arms 22A and 22B respectively. These wings fit in to the recesses 48A and 48B of the asymmetric butterfly member 18 when the second arm is releasably affixed to the asymmetric butterfly member 18. When the second arms 22A and 22B are pressed towards each other the wings come out of the recesses and the second arms are capable of passing between the second extensions 18B and swinging in to the open position 3. Similarly with the first arm and first means, there may be additional means in place of, or in combination with, the described pressure and wings which allow the second arm to be releasably affixed to the asymmetric butterfly member which may include, but is not limited to, additional frictional, magnetic and mechanical means.

Figure 6A:
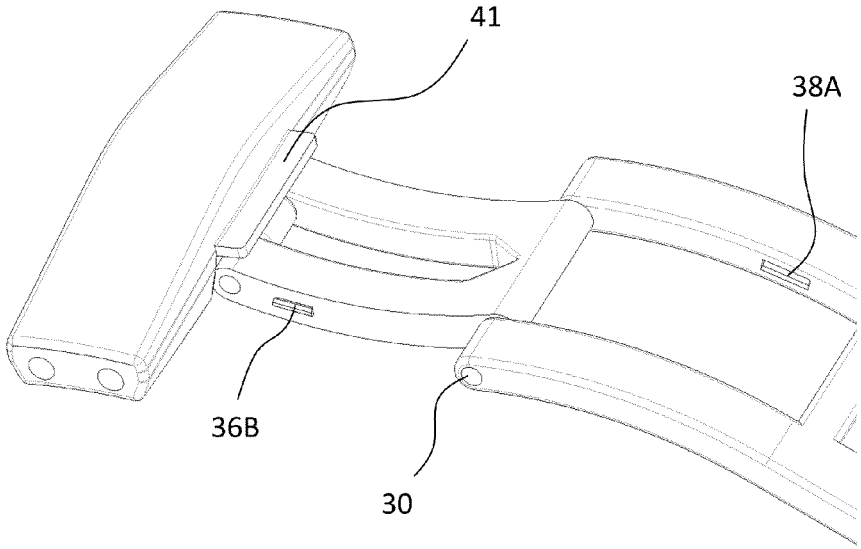
FIGS. 6A and 6B show embodiments a clasp end from an exterior view.

Additionally, or in place of, any means directly releasably affixing the first arm 20 to the asymmetric butterfly member 18, e.g. knobs and recesses of FIG. 2, there can be a means for indirectly releasably affixing the first arm 20 to the asymmetric butterfly member 18 via a means directly releasably connecting link 12 to link 14. Said means can be frictional, mechanical, magnetic or a combination thereof. In one example, link 14 has a recess 40 with a release lever/hook (not shown) which can be activated by one or both of buttons 16A and 16B. Link 12, or connecting piece 28, can then have a member (such as tongue 41 in FIGS. 6A and 6B) which engages, or is engaged by the release lever/hook in the recess 40 of link 14 when links 12 and 14 are pressed together. This means can add additional assurance that the clasp will remain closed in closed position 1. This also will ensure that the first arm is not releasable while in closed position 1.

Figure 5:
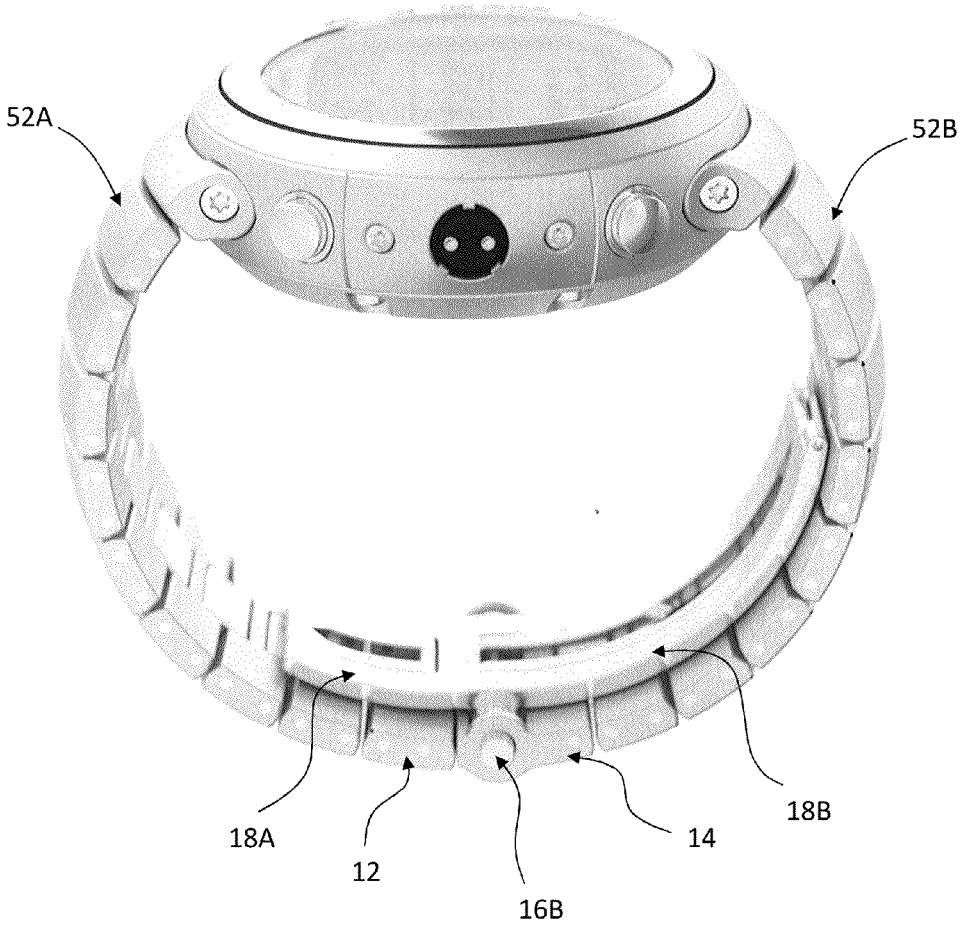
FIG. 5 shows a watch having an asymmetric clasp.

FIG. 4 shows an optional position 4 of the clasp where the first arm 20 is releasably affixed to the asymmetric butterfly member 18 and the second arm is released. FIG. 5 shows the clasp installed on a wristband of a watch. End 18A of the asymmetric member is connected to link 12 which in turn is a part of the first portion of the wrist band 52A. Similarly, end 18B of the asymmetric member is connected to link 14 which in turn is a part of the second portion of the wrist band 52B.

While the present embodiment has been described with a button on both sides of link 14 and each button connected to a second arm capable of displacing the connected second arm, the clasp can be simplified by making one of the buttons a dummy button or removing it all together. Similar modifications can be made without departing from the scope of the present invention. Additionally, means and methods as described for connecting the first arm to the asymmetric butterfly member and for releasably affixing the first arm to the asymmetric butterfly member can be used with the second arm, and vice versa.

In the certain of the embodiments shown in the figures, the connection(s) between the clasp and the links are not adjustable. For example, the swivel link 28 in FIG. 7A can only be connected to the first set of holes 32A and 32C (not shown) and link 12 then connected to the next link in the wristband via standard means by holes 32B and 32D. Similarly, the first arm 20 is rotationally connected in a fixed position on the asymmetric butterfly member 18. However, the clasp can be adjustably connected to the link 12 if the link 12 has a plurality of adjustment holes 32A, 32B, 32A' and 32B', as shown in FIG. 7B and/or the asymmetric butterfly member 18 has a plurality of corresponding positions 31B, 38C and 38D (not shown) for the connection of the first arm 20 as shown in the embodiments of FIGS. 6A-7B.

Figure 6B:
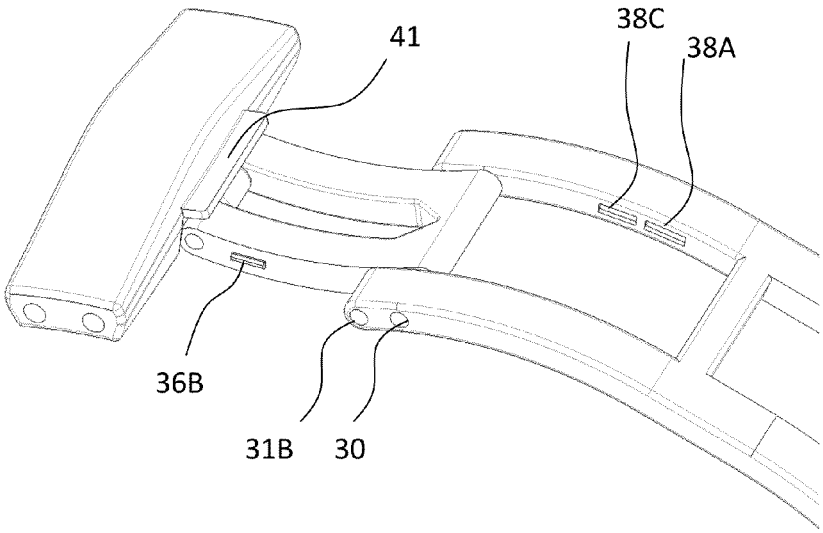
Figure 7A:
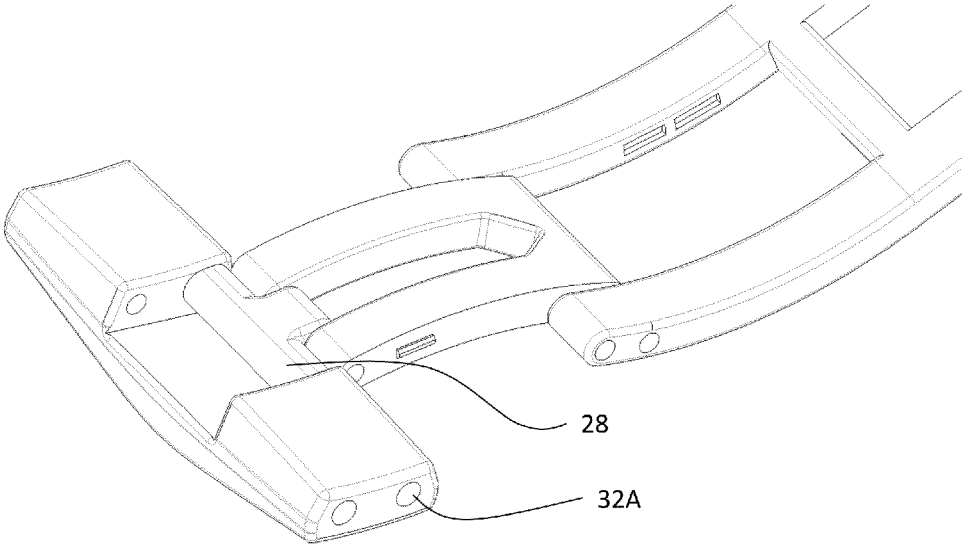
FIGS. 7A and 7B show embodiments of a clasp end from an interior view.
Figure 7B:
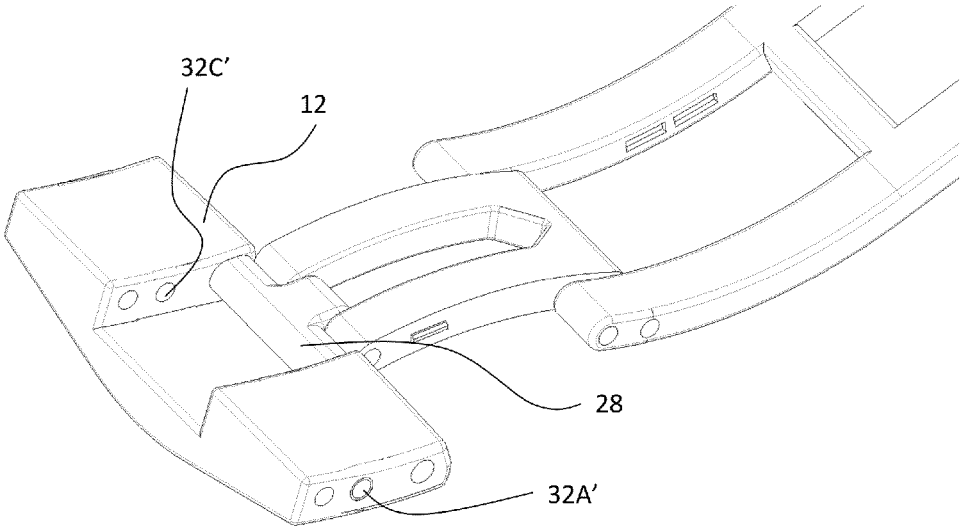

In order to provide additional adjustability for thicknesses of a dive suit for instance, the first end 18A of the asymmetric butterfly member can have additional extensions as shown in FIGS. 6B, 7A and 7B having one, or alternatively more, additional holes each spaced at predetermined intervals. Link 12 would have preferably the same number of additional holes 32 with similar spacing as shown in FIG. 7B. Then, the first arm can be moved with relation to its connection position on both the asymmetric member 18 and link 12 to provide different extension lengths when in the extended closed position 2 while maintaining the connection between the link 12 and 14 in closed position 1.

Additionally, there can be a locking variably adjustable means for moving the connection position of the first arm 20 to the asymmetric butterfly member 18. For example, there can be groves on the inside faces of the first extensions 18A which accept knobs or rods on the end of the first arm so that the first arm can float through a plurality of variable positions, preferably lockable in some or all of the variable positions, to add a greater adjustability of the extension length in the extended open position 2.

Furthermore, while asymmetric butterfly member 18 has been described within the context of the figures, numerous variations can be made without departing from the scope of the invention. For example, one or both of the ends can be a single piece with the first and/or second arm connected to the outer faces of the single piece, instead of to the inner faces of two pieces as shown. The asymmetric butterfly member 18 can be made from one or more pieces and may be more or less asymmetric. Similarly, though the asymmetric butterfly member as well as the totality of the clasp are shown as generally taking a curved shape similar to that of the inside of a wrist band, different shapes can be utilized for both functional and asthetic purposes without departing from the scope of the present invention.

The examples and embodiments described above are only exemplary of the present invention. Other variations are possible and recognizable to one having ordinary skill in the art without departing from the scope of the present invention.

The invention claimed is:

1. A clasp for a band having a plurality of links comprising;

an asymmetric member having a first end portion shorter than a second end portion, a first arm rotationally connected at a first end to the first end portion of the asymmetric member and rotationally connected at the opposite end to a first link, a first means for releasably affixing the first arm to the asymmetric member, a second arm rotationally connected at a first end to the second end portion of the asymmetric member and rotationally connected at the opposite end to a second link, a second means for releasably affixing the second arm to the asymmetric member which is independent from said first means, and wherein the first end portion has two extensions of equal length, the second end portion has two extensions of equal length and wherein the extensions of the first end portion are shorter than those of the second end portion.

2. A clasp in accordance with claim 1, wherein a swivel link between said first arm and said first link, rotationally connected to both, connects the first arm and first link rotationally.

3. A clasp in accordance with claim 1, wherein said first means is a friction means, mechanical means, and/or magnetic means.

4. A clasp in accordance with claim 1, wherein said first arm is rotationally connected at a first end to a terminal end of the first end of the asymmetric member.

5. A clasp in accordance with claim 1, wherein said first end portion of the asymmetric member comprises a gap between the two extensions and the first arm is configured to fit within said gap while releasably affixed to the asymmetric member.

6. A clasp in accordance with claim 1, wherein said second end portion of the asymmetric member comprises a gap between the two extensions and the second arm is configured to fit within said gap while releasably affixed to the asymmetric member.

7. A clasp in accordance with claim 1, wherein said second means is a mechanical means for releasably affixing the second arm to the asymmetric member.

8. A clasp in accordance with claim 7, wherein said second means comprises at least one button which when engaged releases an affixed second arm from the asymmetric member.

9. A clasp in accordance with claim 7, wherein said second means comprises a button on either side of the second link which when engaged releases an affixed second arm from the asymmetric member.

10. A clasp in accordance with claim 7, wherein said second means comprises a button on either side of the second link which when engaged releases an affixed second arm and second link from the asymmetric member.

11. A clasp in accordance with claim 1, wherein said second arm comprises two portions having a gap between them, said two portions capable of being pushed towards each other, thereby reducing the size of the gap, by said second means.

12. A clasp in accordance with claim 1, wherein said second arm comprises two portions having a gap between them, said two portions capable of being pushed towards each other, thereby reducing the size of the gap, and said second means comprises a button on either side of the second link which when engaged pushes said portions towards each other thereby releasing an affixed second arm from the asymmetric member.

13. A clasp in accordance with claim 1, wherein said second means includes a spring.

14. A clasp in accordance with claim 13, wherein said second arm comprises two portions having a gap between them, said two portions capable of being pushed towards each other, thereby reducing the size of the gap, by said second means, and said portions of the second arm act as springs.

15. A clasp in accordance with claim 1, further comprising a third means for releasably affixing the first link directly to the second link.

16. A clasp in accordance with claim 15, wherein said third means is a mechanical means for releasably affixing the first link directly to the second link.

17. A clasp in accordance with claim 16, wherein said second means comprises a button on either side of the second link which when engaged releases an affixed second arm from the asymmetric member and releases the third means releasably affixing the first link to the second link.

18. A clasp in accordance with claim 1, wherein said first arm is rotationally connected to the first link directly.

19. A clasp in accordance with claim 1, wherein said first arm is rotationally connected to the first link via a connector.

20. A clasp in accordance with claim 1, wherein said second arm is rotationally connected to the second link directly.

21. A clasp in accordance with claim 1, wherein said second arm is rotationally connected to the second link via a connector.

22. A wrist band comprising;

a first band portion and a second band portion, an asymmetric member having a first end portion shorter than a second end portion, a first arm rotationally connected at a first end to the first end portion of the asymmetric member and rotationally connected at the opposite end to the first band portion, a first means for releasably affixing the first arm to the asymmetric member, a second arm rotationally connected at a first end to the second end portion of the asymmetric member and rotationally connected at the opposite end to the second band portion, a second means for releasably affixing the second arm to the asymmetric member which is independent from said first means, and wherein the first end portion has two extensions of equal length, the second end portion has two extensions of equal length and wherein the extensions of the first end portion are shorter than those of the second end portion.

23. The wrist band according to claim 22, wherein the first and second band portions are connected to a time piece forming a wrist watch.

* * * * *